US007762265B2

(12) United States Patent
Hicks et al.

(10) Patent No.: US 7,762,265 B2
(45) Date of Patent: Jul. 27, 2010

(54) APPARATUS FOR CONTROLLING DISTRIBUTION OF TOBACCO STRIP

(75) Inventors: Robert E Hicks, Rocky Mount, NC (US); Joseph A. Frady, Richmond, VA (US); S. Keith Garbett, Richmond, VA (US)

(73) Assignee: Universal Leaf Tobacco Company, Inc., Richmond, VA (US)

( * ) Notice: Subject to any disclaimer, the term of this patent is extended or adjusted under 35 U.S.C. 154(b) by 1093 days.

(21) Appl. No.: 11/078,731

(22) Filed: Mar. 14, 2005

(65) Prior Publication Data

US 2006/0201526 A1 Sep. 14, 2006

(51) Int. Cl.
*A24B 7/14* (2006.01)

(52) U.S. Cl. ..... 131/108; 131/300; 131/109.1; 131/84.1; 100/220; 100/215

(58) Field of Classification Search ..... None
See application file for complete search history.

(56) References Cited

U.S. PATENT DOCUMENTS

| | | | |
|---|---|---|---|
| 2,499,310 | A | 2/1950 | Hathaway et al. |
| 2,596,018 | A | 5/1952 | Fishburne et al. |
| 2,619,272 | A | 11/1952 | Boehling |
| 2,675,154 | A | 4/1954 | Fishburne |
| 2,712,407 | A | 7/1955 | Bell et al. |
| 2,763,973 | A | 9/1956 | Atkins |
| 2,766,782 | A | 10/1956 | Bell et al. |
| 3,186,448 | A | 6/1965 | Clark |
| 3,200,859 | A | 8/1965 | Parker, Jr. |

(Continued)

FOREIGN PATENT DOCUMENTS

DE 1 269 489 5/1968

(Continued)

OTHER PUBLICATIONS

Notification of Transmittal of the International Search Report and the Written Opinion of the International Searching Authority, or the Declaration mailed Jun. 7, 2006.

(Continued)

*Primary Examiner*—Philip C Tucker
*Assistant Examiner*—Phu H Nguyen
(74) *Attorney, Agent, or Firm*—Pillsbury Winthrop Shaw Pittman LLP

(57) ABSTRACT

An apparatus is configured to control the distribution of tobacco strip in a charger of a tobacco packing press. The apparatus includes a housing. A plurality of ducts extend from the housing to the charger. Each duct is configured to direct a portion of the air flow from the housing to the charger. A plurality of nozzles are spaced around the perimeter of the charger. Each nozzle is connected to a corresponding one of the plurality of ducts. Each duct may include a flow controller that is selectively openable and closable to direct the portion of the air flow around a perimeter of the charger to distribute the tobacco strip in the charger. A method of controlling distribution of tobacco strip in a charger of a tobacco packing press includes providing an air flow and selectively directing portions of the air flow around a perimeter of the charger to distribute the tobacco strip in the charger.

15 Claims, 4 Drawing Sheets

U.S. PATENT DOCUMENTS

| | | | | | |
|---|---|---|---|---|---|
| 3,288,177 | A | | 11/1966 | Clark | |
| 3,455,345 | A | | 7/1969 | Parker, Jr. | |
| 3,595,282 | A | | 7/1971 | Fishburne et al. | |
| 3,641,734 | A | | 2/1972 | Fishburne | |
| 3,765,324 | A | | 10/1973 | O'Neill | |
| 3,817,298 | A | | 6/1974 | Fishburne | |
| 3,968,619 | A | | 7/1976 | Fishburne | |
| 4,343,131 | A | | 8/1982 | McCormick et al. | |
| 4,353,412 | A | * | 10/1982 | Krumhansl | 165/59 |
| 4,457,125 | A | | 7/1984 | Fishburne | |
| 4,572,065 | A | | 2/1986 | Fishburne | |
| 4,876,955 | A | | 10/1989 | Jackson | |
| 4,889,138 | A | * | 12/1989 | Heitmann et al. | 131/84.1 |
| 5,404,919 | A | | 4/1995 | Felts et al. | |
| 5,529,095 | A | | 6/1996 | Felts et al. | |
| 5,806,531 | A | | 9/1998 | Diehl et al. | |

FOREIGN PATENT DOCUMENTS

| | | |
|---|---|---|
| DE | 102 01 181 | 7/2003 |
| NL | 1 011 102 | 7/2000 |

OTHER PUBLICATIONS

International Search Report of application No. PCT/US2006/007653 filed Mar. 6, 2006.

* cited by examiner

APPARATUS FOR CONTROLLING DISTRIBUTION OF TOBACCO STRIP

BACKGROUND OF THE INVENTION

1. Field of the Invention

The present invention relates to an apparatus for controlling distribution of tobacco strip. The present invention also relates to methods of controlling distribution of tobacco strip.

2. Description of the Related Art

Vertically operating tobacco packing presses are used in tobacco processing to pack tobacco strip, or lamina, into containers, e.g. rectangular cases or cylindrical hogsheads. The container communicates at its top with an elongated, hollow, upright charger. The charger supports a column of tobacco strip extending upwardly from the container. Stationary chargers, vertically movable chargers and telescoping chargers are used. A vertically acting press ram having a press head is aligned above the charger so that the ram can be operated to force the press head downwardly through the charger to, or into, the container. Alternatively, the tobacco packing press may press the tobacco into a compression chamber, from where it is further forced into the container or a sleeve. With the press head raised, the tobacco strip is supplied into the top of the charger, for example by a conveyor positioned below the press head. The tobacco strip is supplied until the charger contains a predetermined quantity of loose uncompacted tobacco strip. The ram is then operated to force the press head downwardly through the charger and compress the entire quantity of tobacco into the container or the compression chamber.

It is desirable to evenly distribute the tobacco strip throughout the container to promote uniform aging of the tobacco and prevent degradation and breakage of the tobacco strip. Current tobacco packing presses include mechanical flaps or distributor blades that move back and forth or in a circular motion and are positioned near the top of the charger to distribute the flow of tobacco strip evenly into the charger. These mechanical systems may be unreliable and their effectiveness varies with the rate of tobacco strip flow into the charger.

SUMMARY OF THE INVENTION

It is an aspect of the present invention to provide an apparatus for controlling the distribution of tobacco strip that evenly distributes the tobacco strip. It is also an aspect of the present invention to provide a method of controlling the distribution of tobacco strip.

According to an aspect of the present invention, an apparatus for controlling distribution of tobacco strip in a charger of a tobacco packing press includes a housing configured to contain an air flow; a plurality of ducts extending from the housing to the charger, each duct being configured to direct a portion of the air flow from the housing to the charger; and a plurality of nozzles spaced around the perimeter of the charger, each nozzle being connected to a corresponding one of the plurality of ducts, wherein each duct includes a flow control device that is selectively openable and closable to direct the portion of the air flow into the charger to distribute the tobacco strip in the charger.

According to another aspect of the present invention, a method of controlling distribution of tobacco strip in a charger of a tobacco packing press includes providing a flow of air; and selectively directing portions of the flow of air around a perimeter of the charger to distribute the tobacco strip in the charger

BRIEF DESCRIPTION OF THE DRAWINGS

Embodiments of the present invention will now be described, by way of example only, with reference to the accompanying schematic drawings in which corresponding reference symbols indicate corresponding parts, and in which.

DETAILED DESCRIPTION

Figure 1:
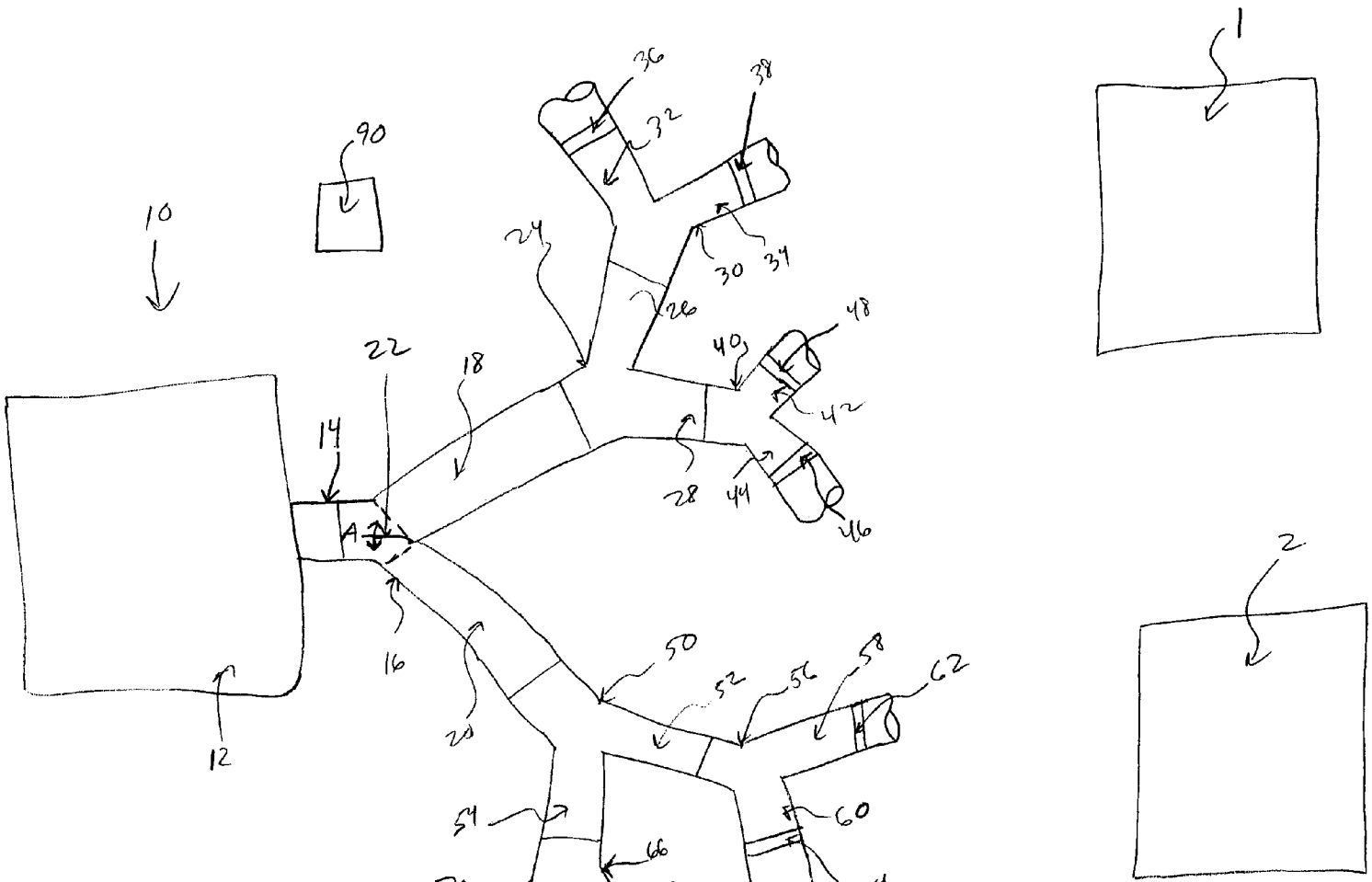
FIG. 1 depicts a plan view of an apparatus for controlling the distribution of tobacco strip in accordance with an embodiment of the present invention.
Figure 2:
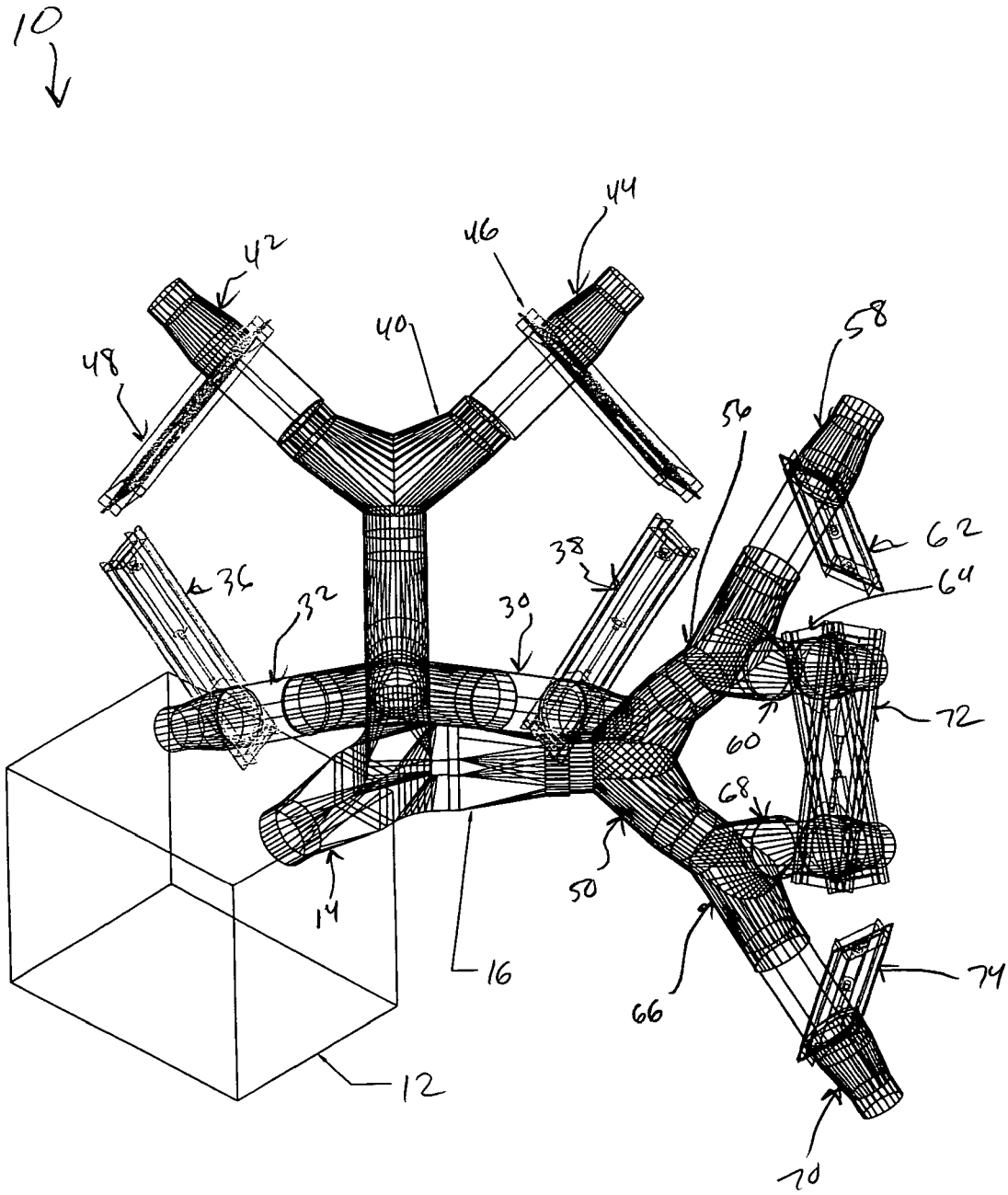
FIG. 2 depicts a perspective view of the apparatus of FIG. 1.

Referring to FIGS. 1 and 2, an apparatus 10 for distributing tobacco strip includes a housing 12. The apparatus 10 may be provided in a tobacco processing plant or factory in which tobacco strip is delivered from redryers to tobacco packing presses 1, 2. The housing 12 is configured to act as a plenum. The housing may contain a flow of air. For example, the housing may include a fan as the source of the air flow, or the housing 12 may be connected to an air flow source. The housing may also contain air that is pressurized to higher than ambient so as to provide a source of air flow from the housing 12. A pump may be operatively connected to the housing to pump air into the housing, thus creating a pressure differential that provides an air flow from the housing 12.

A duct 14 is connected to the housing 12 and forms an outlet from the housing for the air flow. It should be appreciated that as used throughout, the term "duct" may include any conduit, passage, or channel, of any cross sectional size and shape. It should also be appreciated that as used throughout, the term "duct" may include rigid or flexible conduits, passages or channels.

A Y-branch 16 is connected to the duct 14 and includes two ducts 18, 20 forming first and second flow paths. The Y-branch 16 may include a diverter 22 that is operable to divert the entire air flow into one duct of the Y-branch 16. The diverter 22 may be pivotable in the direction shown by arrow A to either position shown in dotted lines.

The duct 18 may be connected to a Y-branch 24 that includes two ducts 26, 28. The duct 26 may be connected to a Y-branch 30 that includes two ducts 32, 34. The ducts 32, 34 may each include a flow control device 36, 38, respectively that is operable to control the air flow through the duct 32, 34. Each flow control device may be operable between two positions, a first position that permits full air flow through the duct and a second position that blocks air flow through the duct. The flow control device may be a solenoid operated damper. The duct 28 may be connected to a Y-branch 40 that includes ducts 42, 44. The ducts 42, 44 may include flow control devices 46, 48, respectively, in the same manner as the ducts 32, 34.

The duct 20 may be connected to a Y-branch 50 that includes ducts 52, 54. The duct 52 may be connected to a Y-branch 56 that includes ducts 58, 60. Each duct 58, 60 may include a flow control device 62, 64, respectively, in the same manner as the ducts 32, 34, 42, 44. The duct 54 may be connected to a Y-branch 66 that includes ducts 68, 70. Each duct 68, 70 may include a flow control device 72, 74, respectively, in the same manner as ducts 32, 34, 42, 44, 58, 60.

As illustrated in FIG. 1, the apparatus 10 may be configured to control distribution of tobacco strip in two tobacco packing presses, including a first tobacco packing press 1 and a second tobacco packing press 2. The diverter 22 is pivoted to block air flow into duct 20 and permit air flow into duct 18. The air flow may be further divided at Y-branch 24 and then further divided at Y-branches 30 and 40. As tobacco strip is being delivered to the tobacco packing press 1, the air flow from ducts 32, 34, 42, 44 may be controlled, as described in more detail below, to evenly distribute the tobacco strip in a charger of the first tobacco packing press 1. While tobacco strip is being delivered to the first tobacco packing press 1, the second tobacco packing press 2 may be attended to remove a container filled with packed tobacco strip and insert an empty container.

Once delivery of a predetermined quantity of tobacco strip to the first tobacco packing press 1 is completed, the diverter 22 may be pivoted to block air flow into duct 18 and permit air flow into duct 20. Tobacco strip is delivered to the second tobacco packing press 2 and the air flow from ducts 58, 60, 68, 70 may be controlled to evenly distribute the tobacco strip to a charger of the second tobacco packing press 2. The first tobacco packing press 1 may be attended to remove the filled container and insert an empty container.

Figure 3:
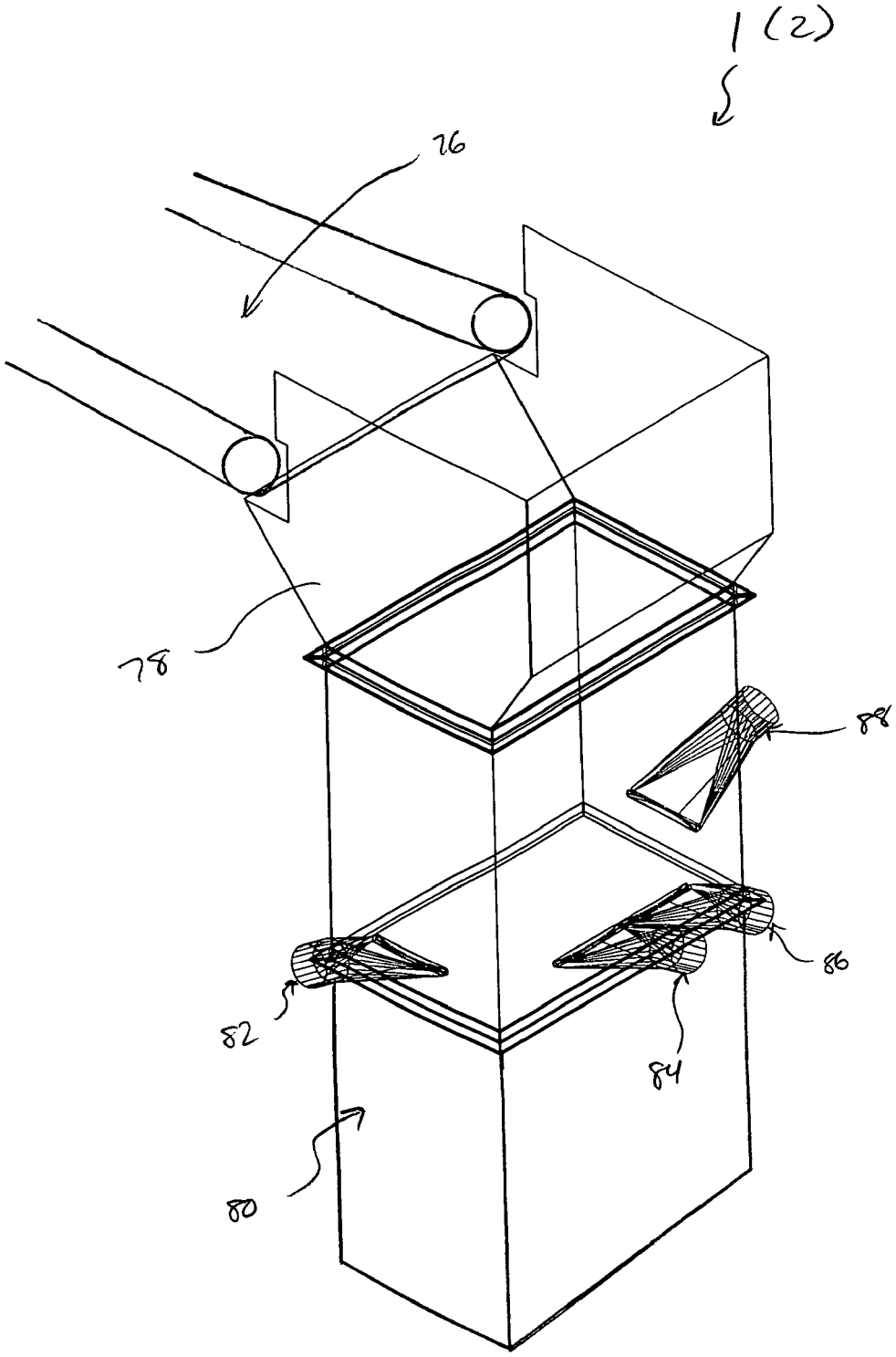
FIG. 3 depicts a nozzle arrangement to control distribution of tobacco strip according to an embodiment of the present invention.

Referring to FIG. 3, tobacco strip is delivered by a conveyor 76. A funnel or hopper 78 may be positioned between the conveyor 76 and a charger 80 of the first tobacco packing press 1 to receive tobacco strip from the conveyor 76. Positioned around the perimeter of the top of the charger 80 are nozzles 82, 84, 86, 88 that are connected to the ducts 30, 32,42, 44. It should be appreciated that the ducts 30, 32, 42, 44 may be connected to the nozzles 82, 84, 86, 88 by flexible ducts, rigid ducts, or by a combination of flexible and rigid ducts. Although not illustrated in FIG. 3, it is understood that second tobacco packing press 2 also includes a charger having nozzles that are connected to ducts 58, 60,68,70. It is also understood that the nozzles of the second tobacco packing press 2 may be connected to the ducts 58, 60, 68, 70 in a manner similar to that described for the first tobacco packing press 1.

The distribution of tobacco strip in the charger 80 may be controlled by opening and closing the flow control devices 36, 38, 46, 48 in the ducts 32, 34, 42, 44 to evenly distribute the tobacco strip in the charger 80. As used herein, the term "evenly distribute" refers to providing a predetermined quantity of uncompacted tobacco strip so that the umcompacted volume of tobacco strip has a substantially uniform density throughout. During filling of the charger 80, the flow control devices 36, 38, 46, 48 may be opened and closed in a predetermined pattern to direct the tobacco strip evenly into all portions of the charger 80. The opening and closing of the flow control devices may be controlled by a programmed logic controller (PLC) 90. It should be appreciated that during filling of the charger of the second tobacco packing press 2, the flow control devices 62, 64, 72, 74 in the ducts 58, 60, 68, 70 may be controlled in a manner similar to that described above with respect to the first tobacco packing press 1.

The PLC 90 may be programmed to open and close the flow control devices in a predetermined pattern. The predetermined pattern may be dependent on a variety of parameters, including for example, the volume of air flow; the number, length, cross sectional size and shape of the ducts; the volume of tobacco strip flow; the range of size of the individual tobacco strips; the moisture content of the tobacco strip; the temperature of the air flow; and/or the size, shape and/or number of nozzles. It should be appreciated that other parameters may be considered. The PLC may also be configured to control the pivoting of the diverter 22.

As shown in FIG. 3, the charger 80 has a rectangular cross section. The nozzles 84, 86 may be positioned on the side opposite the end of the conveyor and the nozzles 82, 88 may be positioned on opposite sides of the charger 80 on corresponding opposite sides of the conveyor 76 to control the distribution of the tobacco strip in the charger. The two nozzles 84, 86 may be positioned on the side opposite the end of the conveyor to maintain an even flow of tobacco strip into the charger 80.

Figure 4:
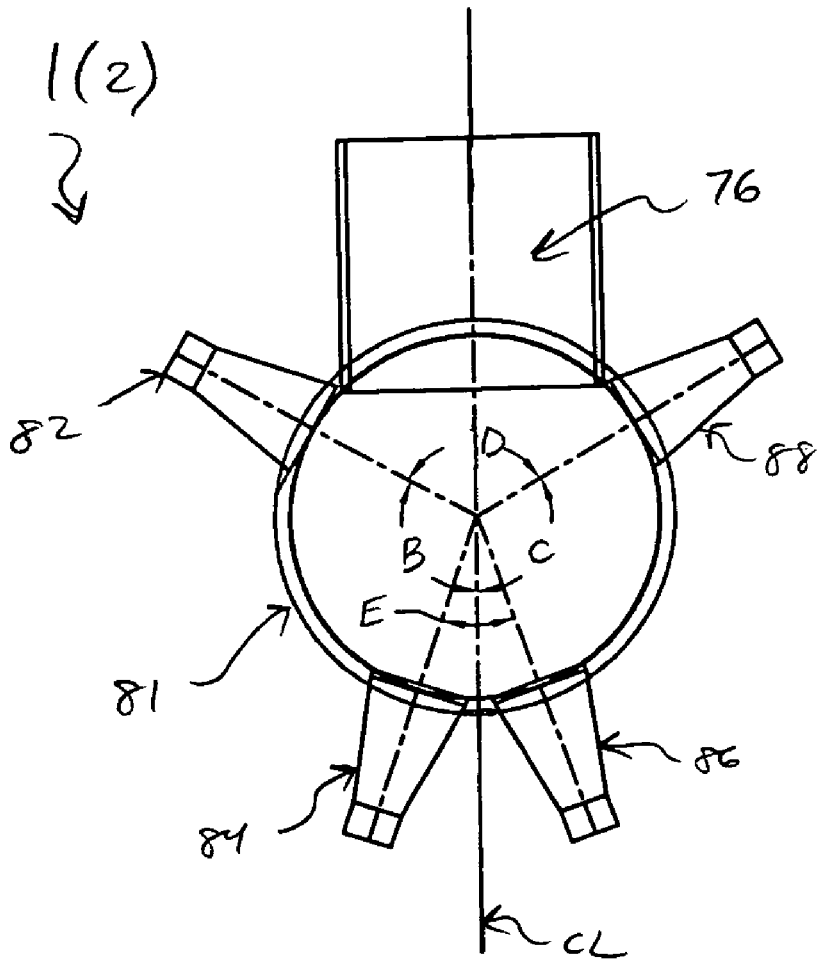
FIG. 4 depicts a nozzle arrangement to control distribution of tobacco strip according to another embodiment of the present invention.

Referring to FIG. 4, a cylindrical charger 81 may be used to pack tobacco into a hogshead. The nozzles 82, 84, 86, 88 may be positioned around the perimeter of the charger 81 near the top of the charger 81. The nozzles 84, 86 may be positioned opposite the end of the conveyor 76 to maintain an even flow of tobacco strip into the charger 81. The axis of the nozzles 82 may be at an angle B to the centerline CL of the charger 81 and the conveyor 76. The axis of the nozzle 88 may be at an angle C to the centerline CL. The axes of the nozzles 82 and 88 may be at an angle D with respect to each other. The axes of the nozzles 84, 86 may be at an angle E with respect to each other. In an embodiment of the present invention, the angles B, C, D may each be 120° and the angle E may be 38°. Although not shown in FIG. 4, it should be appreciated that a funnel or hopper may be placed between the conveyor 76 and the charger 81.

It should be appreciated that the angular spacing of the nozzles may be dependent on a number of parameters. For example, the angular spacing of the nozzles may depend on the diameter of the charger, the speed of the conveyor and the flow rate of the tobacco strip, and/or the height of the charger. Other parameters may also be considered. In a manner similar to FIG. 3 discussed above, the flow control devices may be opened and closed in a predetermined pattern to evenly distribute the tobacco strip in the charger. The PLC 90 may control the opening and closing of the flow control devices. The predetermined pattern may be dependent on a variety of parameters, including those discussed above with respect to FIG. 3.

Although two tobacco packing presses are shown in FIG. 1, it should be appreciated that the apparatus 10 may be configured to control the distribution of tobacco strip to any number of tobacco packing presses, including a single tobacco packing press. It should also be appreciated that although the control of the distribution of tobacco strip to the first and second tobacco packing presses has been described as sequential, the apparatus may be configured to control the distribution of tobacco strip to the packing presses simultaneously. In the event that the apparatus is configured to control the distribution of tobacco strip to more than two packing presses, it should be appreciated that the apparatus may be configured to control the distribution in any number, including all, of the packing presses and in any sequence, including sequentially or simultaneously. For example, in an apparatus configured to control the distribution of tobacco strip in three tobacco packing presses, the apparatus may be configured to control the distribution in two of the tobacco packing presses simultaneously while the third tobacco packing press is attended to remove a full container and insert an empty container.

It should be further appreciated that although the apparatus has been described as controlling the distribution of tobacco strip to tobacco packing presses, the apparatus may be used to control distribution of tobacco strip to other processing apparatus. It should be even further appreciated that the apparatus may be used to control the distribution of material other than tobacco strip.

It should be appreciated that although four ducts and nozzles are shown for each charger, any plural number of ducts and nozzles may be provided for each charger. It should also be appreciated that although a single duct 14 is shown as providing air flow from the housing 12, any number of ducts may provide air flow from the housing. Each of the ducts may include a flow control device controllable by the PLC to control the air flow from the housing. It should be further appreciated that each nozzle may be connected directly to the housing by a duct. Although the flow control devices have been described as either blocking or permitting air flow, it should be appreciated that the flow control devices may be operable to control the air flow in a range between full air flow and complete blocking. The apparatus for controlling the distribution of tobacco strip according to the present invention may be installed into existing tobacco processing plants or factories, or it may be provided as part of a newly constructed tobacco processing plant or factory.

While the present invention has been disclosed with respect to the examples described above, it should be appreciated that numerous modifications may be apparent to those of ordinary skill in the art without departing from the spirit and scope of the present invention.

What is claimed is:

1. An apparatus for controlling distribution of tobacco strip to a plurality of tobacco packing presses, each tobacco packing press having a charger, the charger being configured to receive tobacco strip, the apparatus comprising:

a housing configured to supply an air flow to the charger;

a plurality of ducts extending from the housing to each charger, each duct being configured to direct a portion of the air flow to spaced locations around a perimeter of the charger, from the housing to each charger, at least two of the ducts being configured to direct the portion of the air, flow in different directions;

a plurality of flow controllers in the plurality of ducts, wherein each flow controller is selectively openable and closable to control the portion of the air flow around the perimeter of each charger to distribute the tobacco strip in the charger; and a controller configured to open and close the plurality of flow controllers in the plurality of ducts in a predetermined pattern.

2. An apparatus according to claim 1, wherein the source of air flow is pressurized to a pressure above ambient air pressure.

3. An apparatus according to claim 1, wherein the housing includes an air pump configured to direct air flow from the housing.

4. An apparatus according to claim 1, wherein the controller is configured to open and close the plurality of flow controllers based on one or more parameters including a volume of air flow, a number, length, cross sectional size and shape of the ducts, a volume of tobacco strip flow, a range of size of the tobacco strip, a temperature of the air flow and/or a size, shape and/or number of nozzles in the charger.

5. An apparatus according to claim 1, wherein the plurality of flow controllers are configured to operate in a control the air flow in a range between full air flow and complete blockage.

6. An apparatus according to claim 1, wherein the controller is configured to open and close each flow control device in a pattern configured to evenly distribute the tobacco strip in the charger.

7. An apparatus according to claim 1, further comprising an air flow diverter configured to selectively direct the air flow to only one of the chargers.

8. An apparatus according to claim 1, wherein the changer has a rectangular cross section and first and second nozzles are positioned on a first side of the charger opposite a second side where a conveyor is positioned to deliver the tobacco strip to the charger.

9. An apparatus according to claim 8, wherein third and fourth nozzles are placed on third and fourth sides of the charger, respectively.

10. An apparatus according to claim 1, wherein the charger has a circular cross section and first and second nozzles are positioned opposite a conveyor that delivers the tobacco strip to the charger.

11. An apparatus according to claim 10, wherein the first and second nozzles are angularly spaced from each other.

12. An apparatus according to claim 10, wherein a third nozzle is angularly spaced from the first nozzle and a fourth nozzle is angularly spaced from the second nozzle.

13. An apparatus according to claim 1, wherein the number of flow controllers corresponds to the number of ducts.

14. An apparatus according to claim 1, further comprising a plurality of nozzles at the spaced locations, each nozzle being connected to a corresponding duct and configured to direct the portion of the air flow around the perimeter of the charger.

15. An apparatus according to claim 12, wherein a spacing of the plurality of nozzles around the housing is based on one or more factors including: a housing diameter, speed of the tobacco strip conveyer, flow rate of the tobacco strip and/or height of the housing.

* * * * *